US007937013B2

(12) United States Patent
Lee

(10) Patent No.: US 7,937,013 B2
(45) Date of Patent: May 3, 2011

(54) FUSING DEVICE AND IMAGE FORMING APPARATUS INCLUDING THE SAME

(75) Inventor: Dong Woo Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/625,203

(22) Filed: Nov. 24, 2009

(65) Prior Publication Data

US 2010/0166450 A1 Jul. 1, 2010

(30) Foreign Application Priority Data

Dec. 30, 2008 (KR) ..... 10-2008-0136178

(51) Int. Cl.
*G03G 15/00* (2006.01)

(52) U.S. Cl. ..... 399/90; 399/67; 399/122; 399/330

(58) Field of Classification Search ..... 399/67, 399/90, 122, 320, 328, 330, 334; 219/216, 219/243, 244
See application file for complete search history.

(56) References Cited

U.S. PATENT DOCUMENTS 6,278,094 B1 * 8/2001 Rindfleisch et al. ..... 219/619
7,232,977 B2 * 6/2007 Yamano ..... 219/619

FOREIGN PATENT DOCUMENTS

JP 11-015318 1/1999

OTHER PUBLICATIONS

English language abstract of JP 11-015318, published Jan. 22, 1999.
Machine English language translation of JP 11-015318, published Jan. 22, 1999.

* cited by examiner

*Primary Examiner* — David P Porta
*Assistant Examiner* — Benjamin Schmitt
(74) *Attorney, Agent, or Firm* — Stanzione & Kim, LLP

(57) ABSTRACT

Disclosed herein is a fusing device having an improved heating structure. The fusing device is configured to apply heat and pressure to fix a developer to a print medium and includes a pressure device and a heating device. The heating device includes a heat radiating member extending along a longitudinal direction of the fusing device and terminal parts disposed at both ends of the heat radiating member. Contact points at which current is supplied to the heat radiating member through the terminal parts can be adjusted to change the effective width of heating area.

23 Claims, 8 Drawing Sheets

FUSING DEVICE AND IMAGE FORMING APPARATUS INCLUDING THE SAME

CROSS-REFERENCE TO RELATED APPLICATION

This application claims the benefit of Korean Patent Application No. 2008-0136178, filed on Dec. 30, 2008 in the Korean Intellectual Property Office, the disclosure of which is incorporated herein by reference in its entirety.

TECHNICAL FIELD

Embodiments of the present disclosure relate to a fusing device having an improved heating structure and an image forming apparatus including the same.

BACKGROUND OF RELATED ART

An image forming apparatus refers to an apparatus that forms an image on a print medium according to an input signal. Image forming apparatuses can be printers, copiers, facsimiles and multifunctional devices that integrate one or more functions of aforementioned.

An electro-photographic image forming apparatus is a type of image forming apparatus that scans a light beam corresponding to image information to a photosensitive member charged to a predetermined electrical potential to form an electrostatic latent image on the surface of the photosensitive member. A developer can be supplied to the electrostatic latent image to form a visible image. The visible image formed on the photosensitive member can be transferred directly to a print medium or can be transferred indirectly to the print medium via an intermediary transfer unit. The visible image transferred to the print medium can be fixed to the print medium by heat and pressure applied to the print medium while passing through a fusing device including a heating device and a pressing device.

When the width of the heater in the fusing device does not correspond to the width of the print medium, some issues could arise including the deterioration of the fusing capability, damage to the print medium and/or damage to the fusing device, for example.

SUMMARY OF THE DISCLOSURE

In accordance with one aspect of the present disclosure, a fusing device that applies heat and pressure to fix a developer onto a print medium may be provided to include a pressure device and a heating device. The heating may be arranged to opposingly face the pressure device. The heating device may include a heat radiating member and one or more terminal parts. The heat radiating member may have a length that extends along a longitudinal direction of the fusing device. The one or more terminal parts may each be configured to make contact with the heat radiating member at a contact position along the length of the heat radiating member so as to apply an electrical current to the heat radiating member at the contact position. The contact position may be variable between at least a first position along the length of the heat radiating member and a second position along the length of the heat radiating member.

Each of the one or more terminal parts may be configured to move along the longitudinal direction of the fusing device.

The heating device may further comprise support parts, one or more first screw parts and one or more second screw parts. The support parts may be configured to support longitudinal ends of the heat radiating member. The one or more first screw parts may be rotatably disposed at least one of the support parts. The one or more first screw parts may each have a threaded inner surface. The one or more second screw parts may each have a threaded outer surfaces complementary to the threaded inner surfaces of a corresponding respective one of the one or more first screw parts to thereby mate with the corresponding respective one of one or more first screw parts. The one or more terminal parts may be coupled to a corresponding respective one of the one or more second screw parts.

Alternatively, he heating device may further include one or more rack gears and a driving gear. The driving gear may be in engagement with each of the one or more rack gears such that a rotational movement of the driving gear causes a linear movement of each of the one or more rack gears along the longitudinal direction of the fusing device. Each of the one or more terminal parts may be coupled to a corresponding respective one of the one or more rack gears so as to be in the linear motion in unison with the corresponding respective one of the one or more rack gears. At least one end portion of each of the one or more terminal parts may contact the heat radiating member.

The one or more terminal parts may include first one or more terminal portions and second one or more terminal portions. Each of the first one or more terminal portions may be configured to be in continuous contact with the heat radiating member. The second one or more terminal portions may each be configured to selectively contact the heat radiating member. Each of the second one or more terminal portions may be spaced apart from any one of the first one or more terminal portions.

Alternatively, the heating device may further include a thermal deformation member coupled to each of the second one or more terminal portions. The thermal deformation member may comprise at least two metal plates arranged adjacent each other. Each metal plate of the thermal deformation member may have a thermal expansion coefficient different from that of other ones of the at least two metal plates.

The heat radiating member is made of a compound containing carbon.

The compound may further contain aluminum and silicon.

The compound in the alternative may further contain aluminum phosphate and silicon.

According to another aspect, an image forming apparatus may be provided to include a photosensitive member, a charging device, a light scanning device, a developing device, a transfer device and a fusing device. The charging device may be configured to charge the photosensitive member to a predetermined electric potential. The light scanning device may be configured to radiate light associated with image information to the photosensitive member to form an electrostatic latent image. The developing device may be configured to supply developer to the photosensitive member on which the electrostatic latent image is formed to form a visible image. The transfer device may be configured to transfer the developer on the photosensitive member to a print medium. The fusing device may be configured to apply heat and pressure to fix the developer to the print medium, and may include a heating device and a pressure device. The heating device may include a heat radiating member and terminal parts disposed at both ends of the heat radiating member. The terminal parts may be configured to vary a contact position at which each of the terminal parts makes a contact with the heat radiating member to supply the heat radiating member with an electrical current through the contact.

The terminal parts may be configured to move along a longitudinal direction of the heat radiating member.

The heating device may further comprise support parts, first screw parts and second screw parts. The support parts may be configured to support longitudinal ends of the heat radiating member. The first screw parts may be rotatably disposed at the support parts, and may each have a threaded inner surface. The second screw parts may each have a threaded outer surfaces complementary to the threaded inner surfaces of the first screw parts so as to allow mating of the first screw parts and the second screw parts. The terminal parts may be coupled to the second screw parts.

The image forming apparatus may further comprise a main body configured to define an exterior appearance of the image forming apparatus and a driving part configured to rotate the first screw parts so that the second screw parts move linearly along the longitudinal direction of the heat radiating member.

The terminal parts may include first terminal parts each of which always contact the heat radiating member and second terminal parts each of which selectively contact the heat radiating member.

The heat radiating member is made of a compound containing carbon.

The compound may further contain aluminum and silicon in addition to carbon.

Alternatively, the compound may further contain aluminum phosphate and silicon in addition to carbon.

The distance between the contact positions at which the terminal parts contact the heat radiating member to supply the heat radiating member with the electrical current may be adjusted based on the width of the print medium passing through the fusing device.

According to yet another aspect, a heating roller for applying heat to a print medium carrying developer so as to fix the developer to the printing medium may be provided to include a heat radiating member and terminal parts. The heat radiating member may have a cylindrical shape, a length of which extends along a longitudinal direction of the heating roller. The terminal parts may be disposed at both ends of the heat radiating member, and may each be configured to supply an electrical current to the heat radiating member through an electrical contact with the heat radiating member. The width associated with the heat radiating area of the heat radiating member in which heat is generated may be variable by varying the positions of the electrical contacts between the terminal parts and the heat radiating member.

The width of the heat radiating area of the heat radiating member may be adjusted based on a width of the printing medium.

According to even yet another aspect, a method for controlling a heating roller of an image forming apparatus may be provided to include measuring a first temperature at a first location along a length of the heating roller and a second temperature at a second position along the length of the heating roller; determining whether a difference between the measured first temperature and the measured second temperature exceeds a threshold difference; and adjusting a position of electrical contact through which an electrical current is supplied to the heat radiating member when the difference between the measured first temperature and the measure second temperature exceeds the threshold difference.

The method may further comprise moving one or more terminal parts along a longitudinal direction of the heating roller, the one or more terminal parts each providing a supply path of the electrical current to the heating roller.

According to still yet another aspect, a heating device for heating a print medium to thereby fix toner particles to the print medium may be provided to include an elongate heat radiating member, a first terminal device and a second terminal device. The first terminal device may be coupled to a first longitudinal end of the elongated heat radiating member, and may be configured to make a first electrical contact with the elongated heat radiating member at a first contact point along a length of the elongated heat radiating member, and to supply electrical current to the elongated heat radiating member though the first electrical contact. The second terminal device may be coupled to a second longitudinal end opposite the first longitudinal end of the elongated heat radiating member, and may be configured to make a second electrical contact with the elongated heat radiating member at a second contact point along the length of the elongated heat radiating member, and to supply electrical current to the elongated heat radiating member though the second electrical contact. The distance between the first contact point and the second contact point may be varied.

The distance between the first contact point and the second contact point corresponds substantially to a width of the print medium.

The heating device may further comprise a first sensor, a second sensor and a controller. The first sensor may be disposed at a first position along the heat radiating member, and may be configured to measure a first temperature. The second sensor may be disposed at a second position along the heat radiating member, and may be configured to measure a second temperature. The controller may be configured to control the position of the first contact point of the first terminal device and the position of the second contact point of the second terminal device based on the fist measured temperature and the second measured temperature.

BRIEF DESCRIPTION OF THE DRAWINGS

Various aspects of the disclosure will become apparent and more readily appreciated from the following description of the embodiments, taken in conjunction with the accompanying drawings, in which.

DETAILED DESCRIPTION OF SEVERAL EMBODIMENTS

Figure 1:
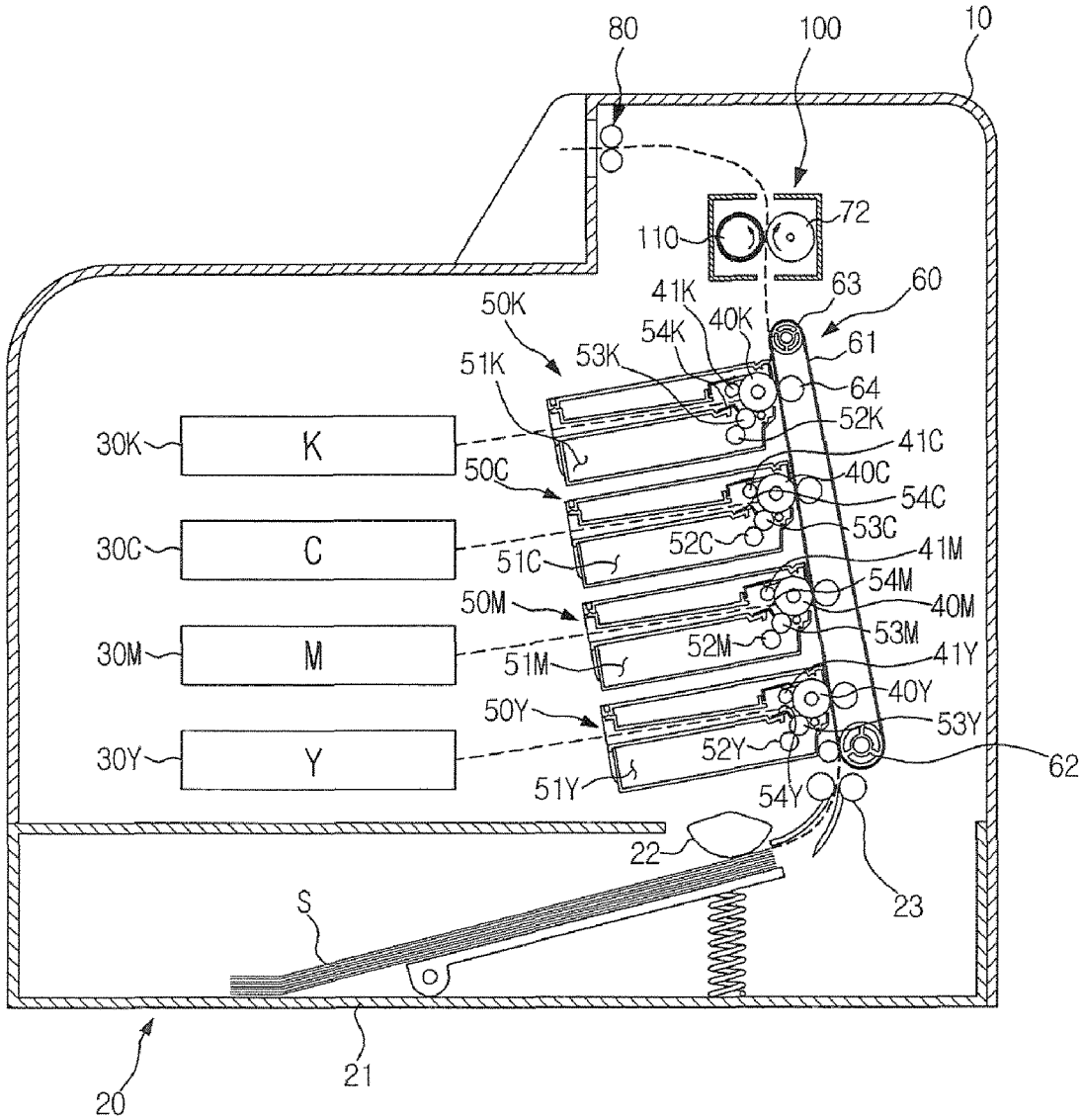
FIG. 1 is a cross-sectional view of an image forming apparatus according to an embodiment of the present disclosure.

Reference will now be made in detail to the several embodiments of the present disclosure, examples of which are illustrated in the accompanying drawings, wherein like reference numerals refer to like elements throughout. The embodiments are described below by referring to the figures.

As illustrated in FIG. 1, an image forming apparatus according to an embodiment can include a main body 10, a print medium supply device 20, light scanning devices 30K, 30C, 30M and 30Y, photosensitive members 40K, 40C, 40M and 40Y, developing devices 50K, 50C, 50M and 50Y, a transfer device 60, a fusing device 100 and a discharging device 80.

The main body 10 can define the exterior appearance of the image forming apparatus, and can support therein various components of the image forming apparatus.

The print medium supply device 20 can include a cassette 21 configured to store one or more print media S, a pickup roller 22 configured to pick up a print medium S loaded in the cassette 21 one sheet at a time and delivery rollers 23 configured to convey the picked-up print medium S towards the transfer device 60.

The light scanning devices 30K, 30C, 30M, and 30Y are each configured to irradiate light corresponding to image information to a respective corresponding one of the photosensitive members 40K, 40C, 40M and 40Y, to form electrostatic latent images on the surfaces of the photosensitive members 40K, 40C, 40M and 40Y.

The photosensitive members 40K, 40C, 40M and 40Y can be charged to a predetermined electrical potential by charging devices 41K, 41C, 41M and 41Y before light is scanned thereto from the light scanning devices 30K, 30C, 30M and 30Y to form the electrostatic latent images on the surfaces of the photosensitive members 40K, 40C, 40M and 40Y by the light scanned from the light scanning devices 30K, 30C, 30M and 30Y.

The developing devices 50K, 50C, 50M and 50Y are each configured to supply developer to the electrostatic latent images formed on the surfaces of the photosensitive members 40K, 40C, 40M and 40Y to form visible images. The developing devices 50K, 50C, 50M and 50Y can include developer receiving units 51K, 51C, 51M and 51Y, supply rollers 52K, 52C, 52M and 52Y, and developing rollers 53K, 53C, 53M and 53Y, respectively. The developer receiving units 51K, 51C, 51M and 51Y can contain developer of different colors, for example, black (K), magenta (M), cyan (C), and yellow (Y), which are to be supplied to the photosensitive members 40K, 40C, 40M and 40Y, respectively. The supply rollers 52K, 52C, 52M and 52Y can supply the developer stored in the developer receiving units 51K, 51C, 51M and 51Y to the developing rollers 53K, 53C, 53M and 53Y. The developers supplied to the developing rollers 53K, 53C, 53M and 53Y can attach to the photosensitive members 40K, 40C, 40M and 40Y, respectively, to form the visible images. Reference numerals 54K, 54C, 54M and 54Y denote regulation members configured to regulate the thicknesses of the developers attached to the developing rollers 53K, 53C, 53M and 53Y, respectively.

The transfer device 60 includes a paper conveyor belt 61, a driving roller 62, and a driven roller 63. Multiple transfer rollers 64 can be located at the inner side of the paper conveyor belt 61 to oppose the photosensitive members 40K, 40C, 40M and 40Y. The transfer rollers 64 can be configured to transfer the developers of the photosensitive members 40K, 40C, 40M and 40Y to a print medium.

The fusing device 100 can include a heating device 110 and a pressure device 72. The print medium onto which an image has been transferred can pass between the heating device 110 and the pressure device 72, and by so passing, the visible image on the print medium can be fixed or fused to the print medium by heat and pressure. Thereafter, the print medium can be discharged to the exterior of the main body 10 by the discharging device 80.

According an aspect of the present disclosure, a heating device, embodiments of which is described hereinbelow, is provided to adjust the width of the heating area thereof.

Figure 2:
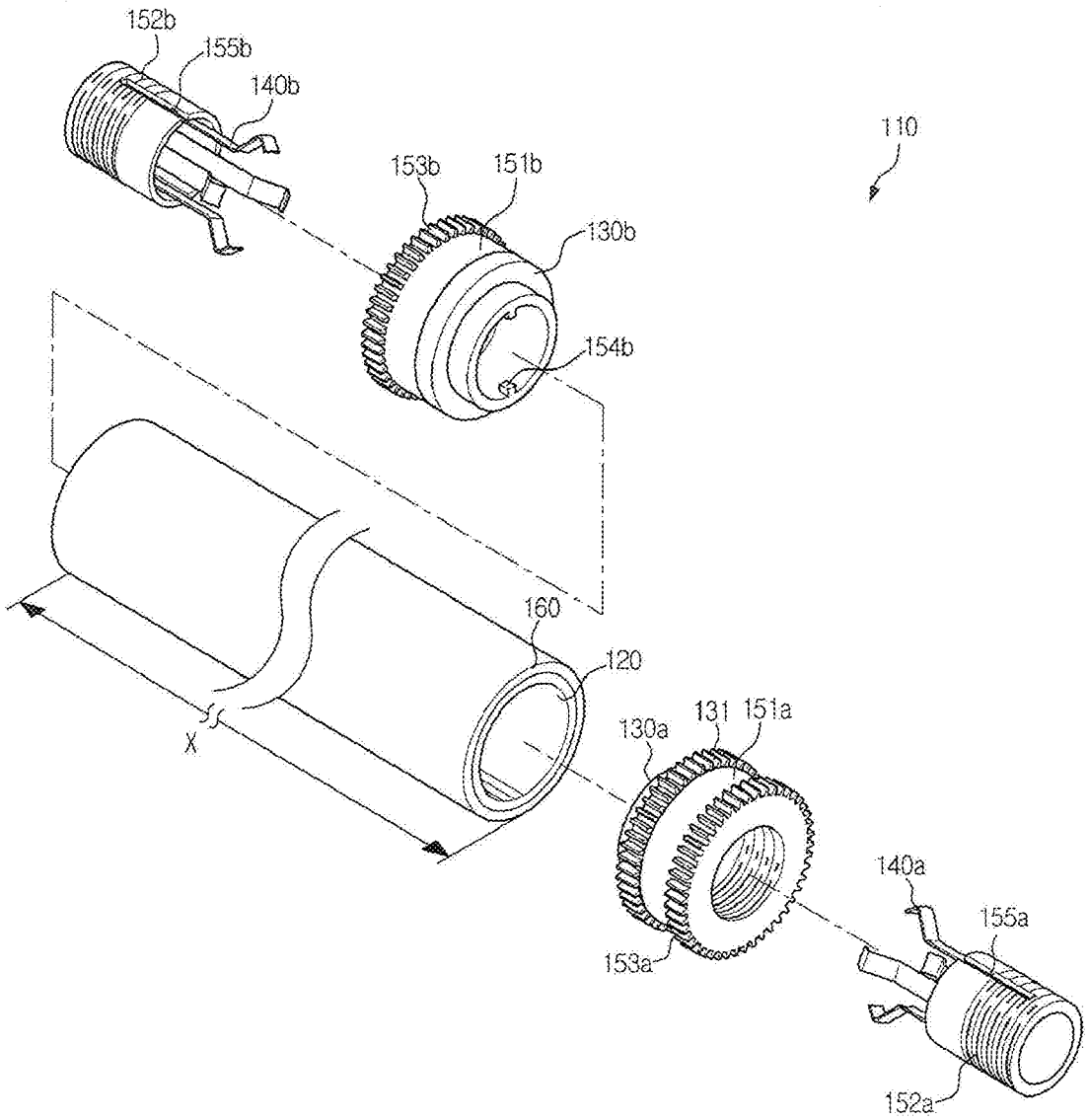
FIG. 2 is a partial exploded perspective view of a heating device usable in a fusing device according to an embodiment of the present disclosure.
Figure 3A:
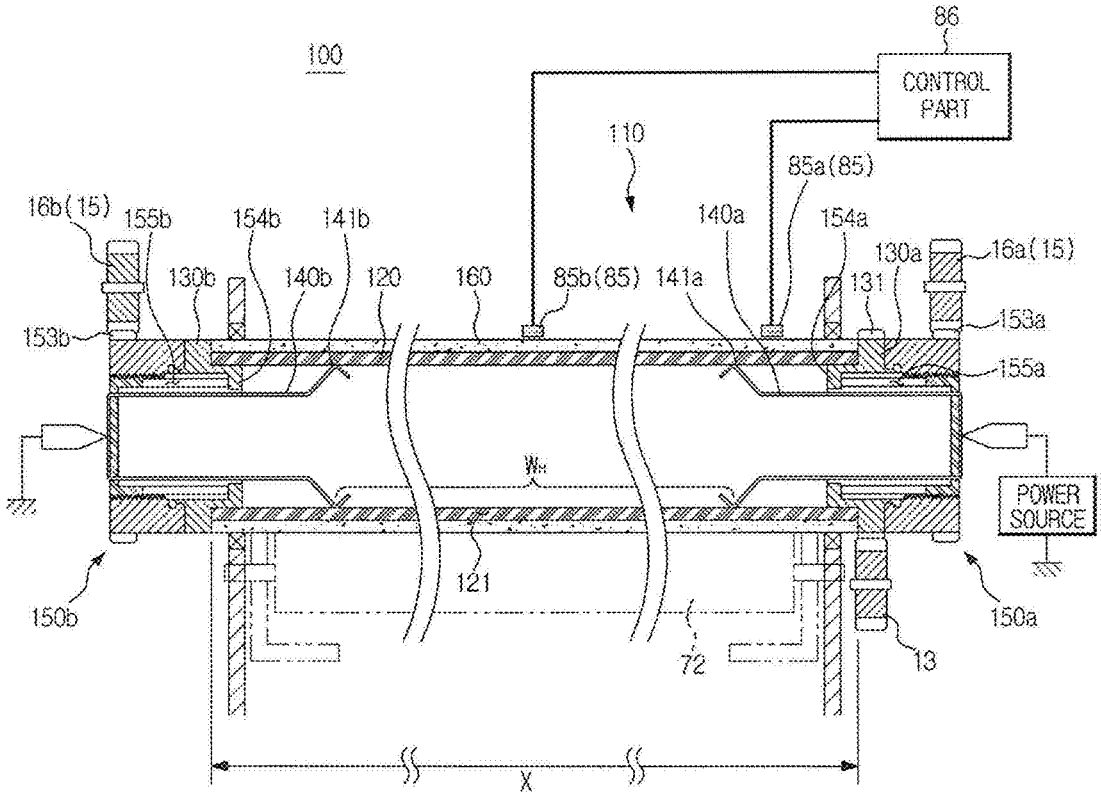
FIGS. 3A and 3B are views illustrating the operation of a fusing device according to an embodiment of the present disclosure.
Figure 3B:
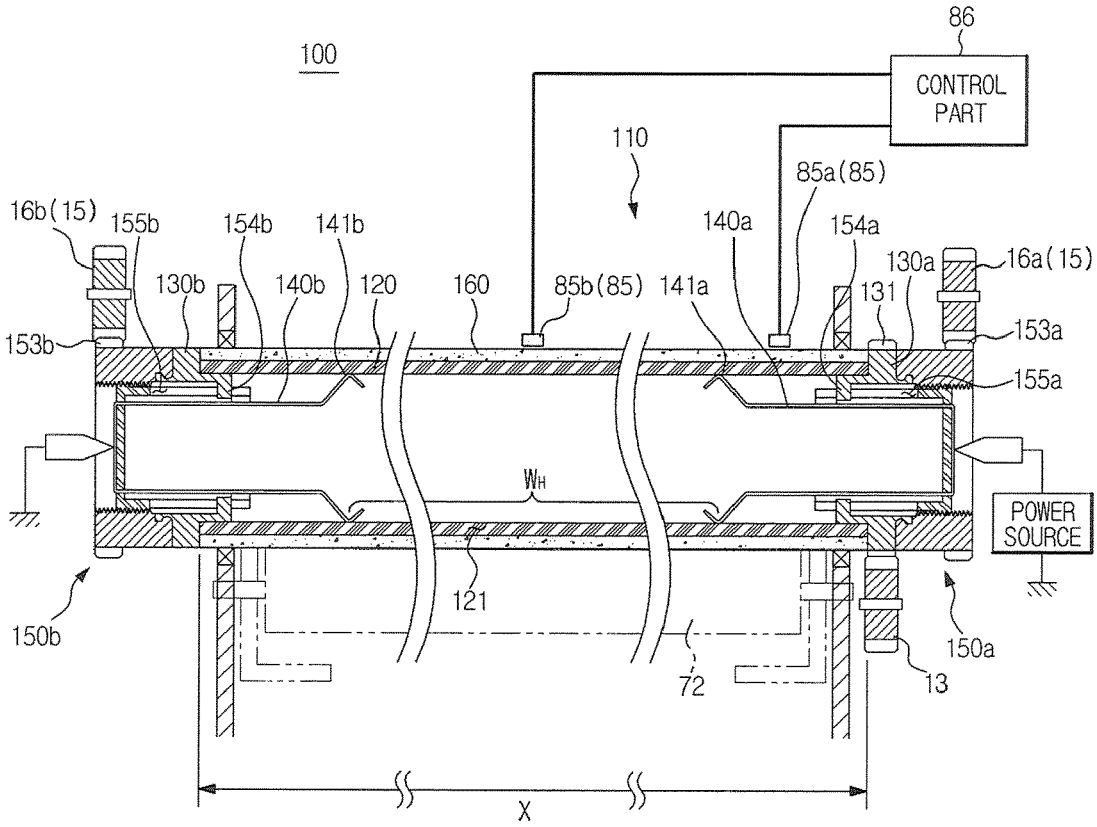
Figure 4:
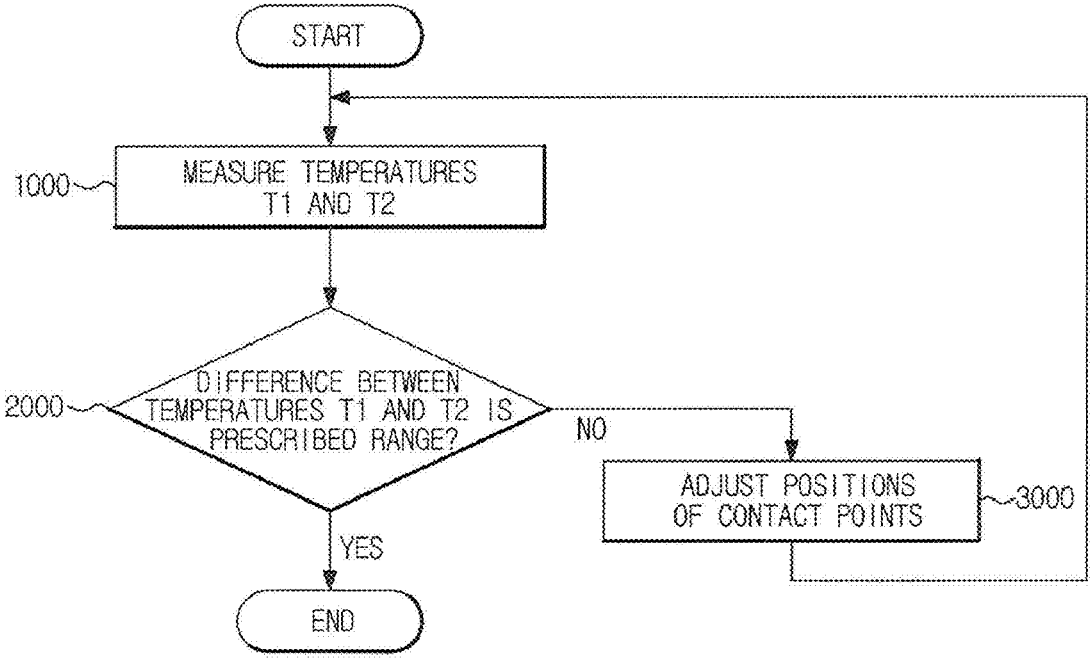
FIG. 4 is a flowchart illustrating a control method of a heating device according to an embodiment of the present disclosure.

FIG. 2 is a partial exploded perspective view of a heating device according to an embodiment of the present disclosure. FIGS. 3A and 3B are views illustrative of the operation of a fusing device according to an embodiment of the present disclosure. FIG. 4 is a flowchart illustrating a control method of a heating device according to an embodiment of the present disclosure.

The heating device 110 can include a heat radiating member 120 having a length along the direction X (i.e., longitudinal direction of the heating device 110), support parts 130*a* and 130*b* configured to support both ends of the heat radiating member 120, terminal parts 140*a* and 140*b* disposed at the ends of the heat radiating member 120 and configured to supply an electrical current to the heat radiating member 120, and conveyor parts 150*a* and 150*b* (see FIGS. 3A and 3B) configured to cause the terminal parts 140*a* and 140*b* to move back and forth along the lengthwise direction X.

The heat radiating member 120 can be configured to radiate heat (e.g., resistive heating) when an electric current is supplied to the heat radiating member 120. In one embodiment, the heat radiating member 120 can be made of a carbon compound. The carbon compound can be formed by mixing carbon powder with aluminum powder and/or silicon powder, for example. In this embodiment, the carbon compound mix can include carbon powder of between about 40 to about 70 percent (%) by weight; aluminum powder of between about 20 to about 30% by weight; and silicon powder of between about 10 to about 30% by weight. The component percentages by weight can be appropriately adjusted when consideration is given to, for example, exothermicity and/or durability. The carbon compound can also be formed by mixing carbon powder with aluminum phosphate powder and/or silicon powder, for example. In this example, the carbon compound mix can include carbon powder of between about 40 to about 60% by weight; aluminum phosphate powder of between about 10 to about 40% by weight; and silicon powder of between about 20 to about 30% by weight. The aluminum phosphate powder can be formed by mixing a phosphoric solution with aluminum of between about 3 to about 30% by weight. A resin binder and a silicic acid solution can be mixed to improve the physical properties (e.g., viscosity) of the carbon compound. Moreover, as illustrated in FIG. 2, a protector 160 configured to protect the heat radiating member 120 can be disposed on the exterior portion of the heat radiating member 120. The protector 160 can be made of a fluorine-based material, for example.

The support parts 130*a* and 130*b* can be fixedly coupled to the respective end of the heat radiating member 120. A driving gear 131 can be disposed at the outer portion of the support part 130*a* so that a rotation force generated from a rotational power source, e.g., a driving motor (not shown), of the heating device 110 can be applied to the heating device 110.

As described above, the terminal parts 140*a* and 140*b* can move forward and backward along the lengthwise or longitudinal direction X by the conveyor parts 150*a* and 150*b*. As a result, the contact points 141*a* and 141*b* at which the heat radiating member 120 makes contact with the terminal parts 140*a* and 140*b* can be varied.

More specifically, the conveyor parts 150*a* and 150*b* can include female screw parts 151*a* and 151*b*, which can be rotatably disposed at the support parts 130*a* and 130*b*, and which can have threaded inner surfaces, and male screw parts 152*a* and 152*b* having threaded outer surfaces that correspond or are complementary to the threaded inner surfaces of the female screw parts 151*a* and 151*b*. The terminal parts 140*a* and 140*b* can be combined or coupled to the ends of the male screw parts 152*a* and 152*b*, respectively. Reference numerals 154*a* and 154*b* denote guide protrusions formed on the inner surfaces of the female screw parts. Reference numerals 155*a* and 155*b* denote guide grooves provided in the male screw parts 152*a* and 152*b* into which the guide protrusions 154*a* and 154*b* can be received. Reference numerals 153*a* and 153*b* denote gear parts formed on the outer portions of the female screw parts 151*a* and 151*b*. A driving force that is used to rotate the female screw parts 151*a* and 151*b* can be provided through the gear parts 153*a* and 153*b*.

When the female screw parts 151*a* and 151*b* start to idle with respect to the support parts 130*a* and 130*b*, the male screw parts 152*a* and 152*b* coupled (e.g., screwed) to the female screw parts 151*a* and 151*b* can be moved backward and forward along the lengthwise direction X of the heat radiating member 120 (see FIGS. 3A and 3B) such that the contact points 141*a* and 141*b* between the terminal parts 140*a* and 140*b* coupled to the ends of the male screw parts 152*a* and 152*b* and the heat radiating member 120 can be varied along the lengthwise direction X.

In one embodiment, the image forming apparatus can include a sensor part 85 configured to measure a temperature along the lengthwise direction X and to generate an electrical signal corresponding to the measured temperature, and a control part 86 configured to receive the electrical signal generated by the sensor part 85. As would be readily understood by those skilled in the art, the control part 86 may be, e.g., a microprocessor, a microcontroller or the like, that includes a CPU to execute one or more computer instructions to implement the various control operations herein described and/or control operations relating to other components of the image forming apparatus, such as, for example, one or more of the print medium supply device 20, light scanning devices 30K, 30C, 30M and 30Y, photosensitive members 40K, 40C, 40M and 40Y, developing devices 50K, 50C, 50M and 50Y, the transfer device 60 and the discharging device 80, and to that end may further include a memory device, e.g., a Random Access Memory (RAM), Read-Only-Memory (ROM), a flesh memory, or the like, to store the one or more computer instructions.

The control part 86 can be configured to control the rotation speed of the heating device 110 and the width ($W_H$) of the heat radiating area 121 of the heat radiating member 120. A method to control the width, $W_H$, of the heating area 121 of the heat radiating member 120 is described below. The sensor part 85 can include a first sensor 85*a* configured to measure a temperature of a middle portion of the heating device 110 and a second sensor 85*b* configured to measure a temperature of an end portion of the heating device 110. The number of sensors and/or measurement positions, however, can vary.

As illustrated in FIGS. 3A and 3B, the driving force of a driving motor (not shown) disposed in the main body 10 can be transferred to the driving gear 131 of the heating device 110 through an input gear 13 such that the heating device 110 can be rotated by the driving force. An electrical current can be supplied to the heat radiating member 120 through the terminal parts 140*a* and 140*b* disposed at the ends of the heating device 110. With the above configuration, heat (e.g., resistive heating) can be applied to a print medium passing through the fusing device 100 in the heat radiating area 121 between the contact points 141*a* and 141*b*.

According to an aspect of the present disclosure, the area between the contact points 141*a* and 141*b*, at which points the heat radiating member 120 contacts the pair of terminal parts 140*a* and 140*b*, that is, the width, $W_H$, of the heat radiating area 121, can be adjusted to correspond to the width of the print medium passing through the fusing device. More specifically, the control part 86 can generate signals such that the terminal parts 140*a* and 140*b* coupled to the male screw parts 152*a* and 152*b* can move by rotating the female screw parts 151*a* and 151*b* of the conveyor parts 150*a* and 150*b*. Such movement can adjust the width, $W_H$, of the heat radiating area 121 of the heat radiating member 120 to correspond to the width of the print medium. To control the width, $W_H$, of the heat radiating area 121, the image forming apparatus can include a driving device 15 disposed in the main body 10. The driving device 15 can include conveyor gears 16*a* and 16*b* engaged with the gear parts 153*a* and 153*b* and disposed on the outer portions of the female screw parts 151*a* and 151*b* and a driving motor (not shown) configured to driver the conveyor gears 16*a* and 16*b*.

As illustrated in FIG. 4, the image forming apparatus can control the heating device 110 based on temperature information measured by the sensor part 85. A control method of the heating device 110 can include measuring temperatures along the lengthwise direction X of the heating device 110 at 1000. At 2000, whether the difference between the measured temperatures is within a predetermined range can be determined. At 3000, the positions of the contact points 141*a* and 141*b* at which the terminal parts 140*a* and 140*b* contact the heat radiating member 120 can be controlled when the difference between the measured temperatures is outside the predetermined range. For example, when a difference ($T_1$-$T_2$) between a first temperature ($T_1$) measured by the first sensor 85*a* and a second temperature ($T_2$) measured by the second sensor 85*b* is outside a predetermined range, the control part 86 can send a driving signal to the driving motor that drives the conveyor gears 16*a* and 16*b*. The female screw parts 151*a* and 151*b* can be rotated by the rotation force received from the conveyor gears 16*a* and 16*b*. The male screw parts 152*a* and 152*b* can be rotated by the rotation of the female screw parts 151*a* and 151*b*, and, as a result, the heat radiating area 121 of the heat radiating member 120 can be adjusted.

As described above, because the width of the heat radiating area of the heat radiating member can be adjusted according to the width of the print medium or according to a temperature difference of the heating device, the heating device or the pressure device is less likely to break or be damaged by overheating. When the width of the heat radiating area 121 of the heat radiating member is wider than the width of the print medium passing through the fusing device, components of the heating device and the pressure device can break or be damaged because the heat generated at the ends of the heating device may not dissipate normally. According to various embodiments according to an aspect of the present disclosure as described herein, however, the likelihood of damages to the heating device and/or the pressure device can be reduced. Moreover, damage to the print medium caused by overheating can also be mitigated.

Because the fusing device 100 can control the width, $W_H$, of the heat radiating area 121 of the heat radiating member 120 by adjusting the positions of the terminal parts 140*a* and 140*b* electrically connected to the heat radiating member 120, the fusing device 100 provides a structure that is simpler and has low manufacturing costs when compared with a fusing device having multiple heat radiating members of different widths, for example.

Moreover, because the width, $W_H$, of the heat radiating area 121 can be linearly adjusted, precise control of the heat radiating area may be possible. For example, the width, $W_H$, of the heat radiating area 121 of the heating device can be controlled to within a few millimeters of a desired position based on the number of rotations of the female screw parts 151*a* and 151*b*. As a result, the fusing device can control the width, $W_H$, of the heat radiating area 121 such that the width, $W_H$, corresponds or is substantially the same as one of the possible width sizes of the print media.

Figure 5A:
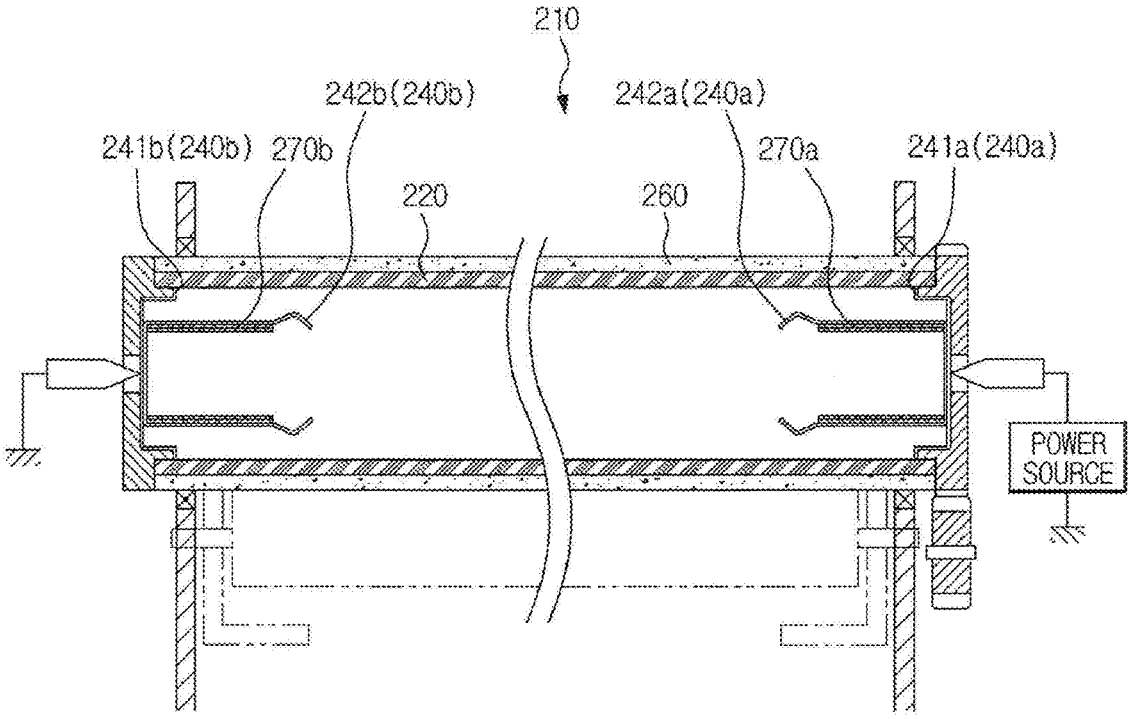
FIGS. 5A and 5B are cross-sectional views of a heating device according to another embodiment of the present disclosure.
Figure 5B:
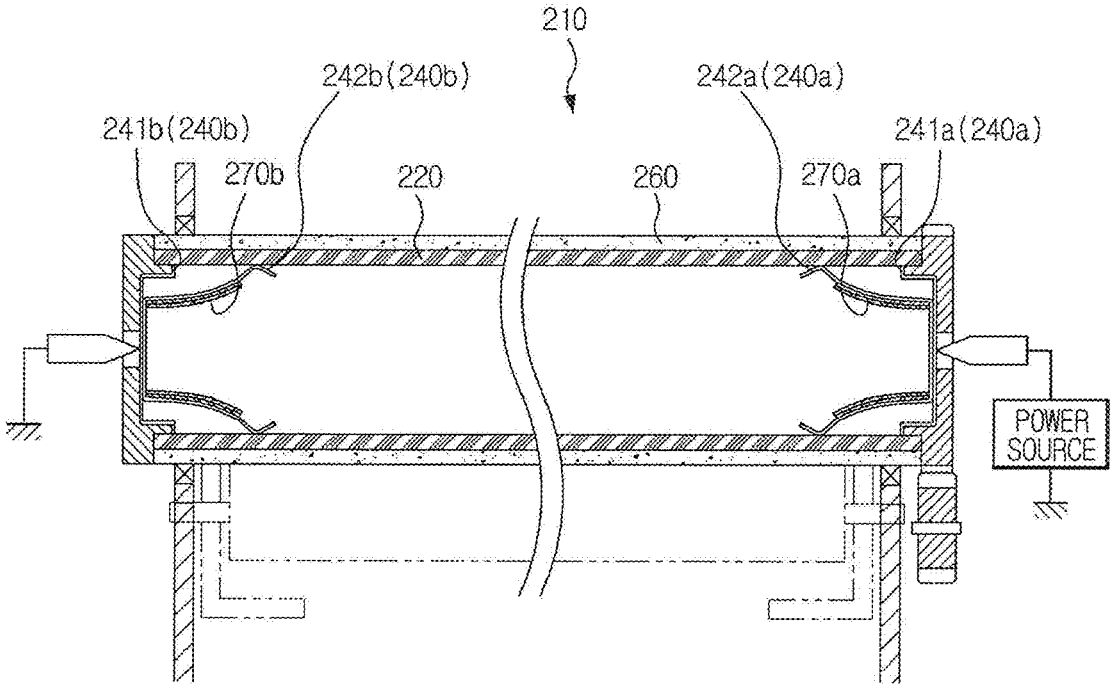

FIGS. 5A and 5B are cross-sectional views of a heating device according to another embodiment of the present disclosure. A description of the like elements previously described in the above embodiments will not be repeated for the sake of brevity.

Terminal parts 240*a* and 240*b* of a heating device 210 can include first terminal parts 241*a* and 241*b*, which are configured to be in continuous contact with the heat radiating member 220, and second terminal parts 242*a* and 242*b*, which are configured to selectively be in contact with the heat radiating member 220. The second terminal parts 242*a* and 242*b* can be coupled to bimetal parts 270*a* and 270*b*. The bimetal parts 270*a* and 270*b* can be made by, for example, having two thin metal plates with different thermal expansion coefficients joined together.

When the bimetal parts 270*a* and 270*b* are not heated (see FIG. 5A), an electrical current can be applied to the heat radiating member 220 through the first terminal parts 241*a* and 241*b*. When the bimetal parts 270*a* and 270*b* are heated (see FIG. 5B), an electrical current can be applied to the heat radiating member 220 through the second terminal parts 242*a* and 242*b*. In other words, the position of the contact points at which the current is applied to the heat radiating member 220 can be varied by the operation of the bimetal parts 270*a* and 270*b*.

Although a pair of bimetal parts is used in this embodiment, two or more pairs of bimetal portions can be used in other embodiments to provide multiple variable positions of contact points.

Figure 6:
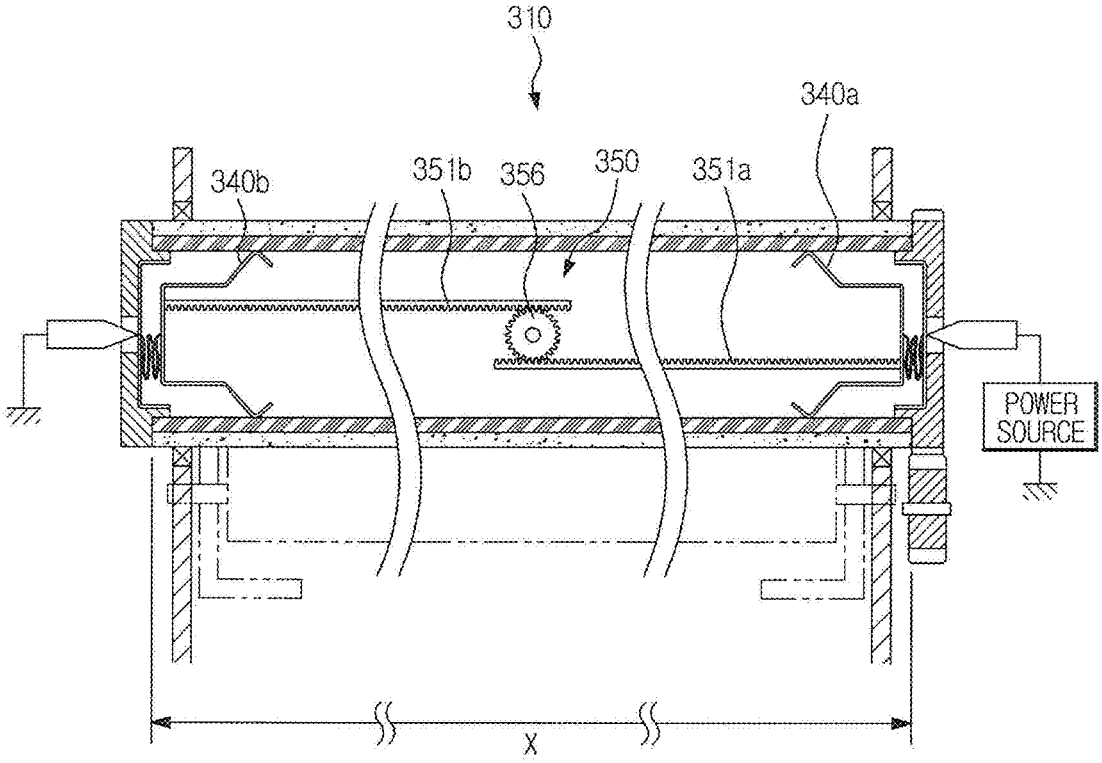
FIG. 6 is a cross-sectional view of a heating device according to another embodiment of the present disclosure.

FIG. 6 is a cross-sectional view of a heating device according to another embodiment of the present disclosure.

A conveyor device 350 of a heating device 310 can include rack gears 351*a* and 351*b*, and a driving gear 356 engaged with the rack gears 351*a* and 351*b*. Terminal parts 340*a* and 340*b* can be coupled to the rack gears 351*a* and 351*b* such that the ends of the terminal parts 340*a* and 340*b* can contact the heat radiating member 320 at variable positions. A driving motor (not shown) coupled to the driving gear 356 can be operated such that the rack gears 351*a* and 351*b* move forward and backward along the lengthwise direction X of the heating device 310.

Although various aspects of the disclosure have been described by way of several embodiments described in detail, these aspects of the disclosure are not limited to any specific embodiments or any described details thereof as it should be apparent to those skilled in the art that various modifications and variations can be made to what is specifically described herein.

For example, the terminal parts provided at both ends of the heating device can be shifted or moved by various methods in addition to those specifically described herein.

The heating device has been described as a roller type device that contacts a print medium and applies heat. The type of the heating device, however, need not be so limited.

Although the terminal parts of the heating device and the conveyor parts that convey the terminal parts have been described as being symmetrical to both ends of the heating device, in some embodiments, the conveyor parts can be provided only at one end of the heating device and not at the other end.

As is apparent from the above description, an improved heating structure of a developer can be provided, thereby improving fusing capability, protecting print sheets, and protecting a fusing device.

Although several embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A fusing device that applies heat and pressure to fix developer onto a print medium, comprising:

a pressure device; and a heating device arranged to opposingly face the pressure device, the heating device including a heat radiating member and one or more terminal parts, the heat radiating member having a length that extends along a longitudinal direction of the fusing device, the one or more terminal parts each being configured to make contact with the heat radiating member at a contact position along the length of the heat radiating member so as to apply an electrical current to the heat radiating member at the contact position, the contact position being variable between at least a first position along the length of the heat radiating member and a second position along the length of the heat radiating member.

2. The fusing device according to claim 1, wherein each of the one or more terminal parts is configured to move along the longitudinal direction of the fusing device.

3. The fusing device according to claim 2, wherein the heating device further includes:

support parts configured to support longitudinal ends of the heat radiating member;

one or more first screw parts rotatably disposed at least one of the support parts, the one or more first screw parts each having a threaded inner surface; and one or more second screw parts each having a threaded outer surfaces complementary to the threaded inner surfaces of a corresponding respective one of the one or more first screw parts to thereby mate with the corresponding respective one of one or more first screw parts, the one or more terminal parts being coupled to a corresponding respective one of the one or more second screw parts.

4. The fusing device according to claim 2, wherein the heating device further includes:

one or more rack gears; and a driving gear in engagement with each of the one or more rack gears such that a rotational movement of the driving gear causes a linear movement of each of the one or more rack gears along the longitudinal direction of the fusing device, wherein each of the one or more terminal parts is coupled to a corresponding respective one of the one or more rack gears so as to be in the linear motion in unison with the corresponding respective one of the one or more rack gears, at least one end portion of each of the one or more terminal parts contacting the heat radiating member.

5. The fusing device according to claim 1, wherein the one or more terminal parts include first one or more terminal portions each configured to be in continuous contact with the heat radiating member and second one or more terminal portions each configured to selectively contact the heat radiating member, each of the second one or more terminal portions being spaced apart from any one of the first one or more terminal portions.

6. The fusing device according to claim 5, wherein the heating device further includes a thermal deformation member coupled to each of the second one or more terminal portions, the thermal deformation member comprising at least two metal plates arranged adjacent each other, each metal plate of which having a thermal expansion coefficient different from that of other ones of the at least two metal plates.

7. The fusing device according to claim 1, wherein the heat radiating member is made of a compound containing carbon.

8. The fusing device according to claim 7, wherein the compound further contains aluminum and silicon.

9. The fusing device according to claim 7, wherein the compound further contains aluminum phosphate and silicon.

10. An image forming apparatus, comprising:

a photosensitive member;

a charging device configured to charge the photosensitive member to a predetermined electric potential;

a light scanning device configured to radiate light associated with image information to the photosensitive member to form an electrostatic latent image;

a developing device configured to supply developer to the photosensitive member on which the electrostatic latent image is formed to form a visible image;

a transfer device configured to transfer the developer on the photosensitive member to a print medium; and a fusing device having a heating device and a pressure device, the fusing device being configured to apply heat and pressure to fix the developer to the print medium, wherein the heating device includes a heat radiating member and terminal parts disposed at both ends of the heat radiating member, the terminal parts being configured to vary a contact position at which each of the terminal parts makes a contact with the heat radiating member to supply the heat radiating member with an electrical current through the contact.

11. The image forming apparatus according to claim 10, wherein the terminal parts are configured to move along a longitudinal direction of the heat radiating member.

12. The image forming apparatus according to claim 11, wherein the heating device further includes:

support parts configured to support longitudinal ends of the heat radiating member;

first screw parts rotatably disposed at the support parts, the first screw parts having a threaded inner surface; and second screw parts having a threaded outer surfaces complementary to the threaded inner surfaces of the first screw parts so as to allow mating of the first screw parts and the second screw parts, the terminal parts being coupled to the second screw parts.

13. The image forming apparatus according to claim 12, further comprising:

a main body configured to define an exterior appearance of the image forming apparatus; and a driving part configured to rotate the first screw parts so that the second screw parts move linearly along the longitudinal direction of the heat radiating member.

14. The image forming apparatus according to claim 10, wherein the terminal parts include first terminal parts each of which always contact the heat radiating member and second terminal parts each of which selectively contact the heat radiating member.

15. The image forming apparatus according to claim 10, wherein the heat radiating member is made of a compound containing carbon.

16. The image forming apparatus according to claim 15, wherein the compound further contains aluminum and silicon.

17. The image forming apparatus according to claim 15, wherein the compound further contains aluminum phosphate and silicon.

18. The image forming apparatus according to claim 10, wherein a distance between the contact positions at which the terminal parts contact the heat radiating member to supply the heat radiating member with the electrical current is adjusted based on a width of the print medium passing through the fusing device.

19. A heating roller for applying heat to a print medium carrying developer so as to fix the developer to the printing medium, comprising:

a heat radiating member having a cylindrical shape, whose length extending along a longitudinal direction of the heating roller; and terminal parts disposed at both ends of the heat radiating member, the terminal parts each being configured to supply an electrical current to the heat radiating member through an electrical contact with the heat radiating member, wherein a width associated with a heat radiating area of the heat radiating member in which heat is generated is variable by varying positions of the electrical contacts between the terminal parts and the heat radiating member.

20. The image forming apparatus according to claim 19, wherein the width of the heat radiating area of the heat radiating member is adjusted based on a width of the printing medium.

21. A heating device for heating a print medium to thereby fix toner particles to the print medium, comprising:

an elongate heat radiating member;

a first terminal device coupled to a first longitudinal end of the elongated heat radiating member, the first terminal device being configured to make a first electrical contact with the elongated heat radiating member at a first contact point along a length of the elongated heat radiating member, the first terminal device being configured to supply electrical current to the elongated heat radiating member though the first electrical contact; and a second terminal device coupled to a second longitudinal end opposite the first longitudinal end of the elongated heat radiating member, the second terminal device being configured to make a second electrical contact with the elongated heat radiating member at a second contact point along the length of the elongated heat radiating member, the second terminal device being configured to supply electrical current to the elongated heat radiating member though the second electrical contact, wherein a distance between the first contact point and the second contact point is variable.

22. The heating device of claim 21, wherein the distance between the first contact point and the second contact point corresponds substantially to a width of the print medium.

23. The heating device of claim 21, further comprising:

a first sensor disposed at a first position along the heat radiating member, the first sensor being configured to measure a first temperature;

a second sensor disposed at a second position along the heat radiating member, the second sensor being configured to measure a second temperature; and a controller configured to control the position of the first contact point of the first terminal device and the position of the second contact point of the second terminal device based on the fist measured temperature and the second measured temperature.

* * * * *